US005855053A

United States Patent [19]

Arena

[11] Patent Number: 5,855,053

[45] Date of Patent: Jan. 5, 1999

[54] METHOD AND FORMING DIE FOR FABRICATING SPIRAL GROOVE TORQUE TUBE ASSEMBLIES

[75] Inventor: Aldo Arena, Smithtown, N.Y.

[73] Assignee: Northrop Grumman Corporation, Los Angeles, Calif.

[21] Appl. No.: 664,727

[22] Filed: Jun. 18, 1996

[51] Int. Cl.[6] ..... B23P 11/00; B21B 17/02; B21D 28/18

[52] U.S. Cl. ..... 29/523; 72/370; 72/62; 29/283.5

[58] Field of Search ..... 29/522.1, 523, 29/72, 283.5; 285/382.1, 382.2, 382.4, 382.7; 403/274, 273, 277, 279, 280, 281; 72/61, 62, 370, 707

[56] References Cited

U.S. PATENT DOCUMENTS

| | | | |
|---|---|---|---|
| 582,659 | 11/1897 | White et al. . | |
| 1,291,388 | 1/1919 | Bright et al. . | |
| 1,329,479 | 2/1920 | Savon . | |
| 2,233,471 | 3/1941 | Clements . | |
| 2,976,907 | 3/1961 | Harvey et al. . | |
| 3,163,141 | 12/1964 | Wesley et al. . | |
| 3,319,690 | 5/1967 | Rosan et al. | 29/523 |
| 3,744,122 | 7/1973 | Ridenour et al. | 285/382.2 |
| 3,750,267 | 8/1973 | Otto | 29/523 |
| 3,810,372 | 5/1974 | Queyroix . | |
| 4,125,000 | 11/1978 | Grob . | |
| 4,212,099 | 7/1980 | Williams et al. | 29/523 |
| 4,229,259 | 10/1980 | Vaill et al. | 29/523 |
| 4,330,924 | 5/1982 | Kushner et al. | 285/382.2 |
| 4,371,199 | 2/1983 | Kushner et al. | 285/382.2 |
| 4,397,171 | 8/1983 | Suh et al. . | |
| 4,513,488 | 4/1985 | Arena . | |
| 4,523,872 | 6/1985 | Arena et al. . | |
| 4,561,799 | 12/1985 | Arena | 285/382.2 |
| 4,598,451 | 7/1986 | Ohki . | |
| 4,646,548 | 3/1987 | Zimmerli et al. | 29/523 |
| 4,666,186 | 5/1987 | Twomey | 285/382.2 |
| 5,400,636 | 3/1995 | Bailey | 72/370 |

FOREIGN PATENT DOCUMENTS

| | | | |
|---|---|---|---|
| 60-106629 | 6/1985 | Japan . | |
| 1144745 | 3/1985 | U.S.S.R. . | |
| 9114894 | 10/1991 | WIPO | 285/382.2 |

*Primary Examiner*—S. Thomas Hughes
*Assistant Examiner*—Tisa Stewart
*Attorney, Agent, or Firm*—Terry J. Anderson; Karl J. Hoch, Jr.

[57] ABSTRACT

A method which is directed to the fabricating or forming of tubular members of the torque tube type which may be utilized as torque joints for the drive shafts or steering connections of motor vehicles or in connection with articulating linkages for high-lift aircraft systems, marine systems or for other various military or non-military commercial physical application where it is intended to react to torsional and axial loads which are ordinarily encountered in torque joints, steering linkages, drive shafts and the like. More particularly, pursuant to a further aspect, provision is made for a device which is in the form of a novel die arrangement for electromagnetically forming spirally oriented grooves in tubular members and therewith interposed end fittings, particularly of the type which are adapted to react to intense torsional and axial loads encountered by torque joints and the like, and which are designed to appreciably reduce or even essentially eliminate stress concentrations so as to improve upon the fatigue life and, resultingly, extend the service life or durability of the torque tube assembly.

16 Claims, 2 Drawing Sheets

METHOD AND FORMING DIE FOR FABRICATING SPIRAL GROOVE TORQUE TUBE ASSEMBLIES

BACKGROUND OF THE INVENTION

1. Field of the Invention

The present invention relates to a method which is directed to the fabricating or forming of tubular members of the torque tube type which may be utilized as torque joints for the drive shafts or steering connections of motor vehicles or in connection with articulating linkages for high-lift aircraft systems, marine systems or for other various military or non-military commercial physical application where it is intended to react to torsional and axial loads which are ordinarily encountered in torque joints, steering linkages, drive shafts and the like. More particularly, pursuant to a further aspect of the invention, provision is made for a device which is in the form of a novel die arrangement for electromagnetically forming spirally oriented grooves in tubular members and therewith interposed end fittings, particularly of the type which are adapted to react to intense torsional and axial loads encountered by torque joints and the like, and which are designed to appreciably reduce or even essentially eliminate stress concentrations so as to improve upon the fatigue life and, resultingly, extend the service life or durability of the torque tube assembly.

In essence, it is a well-known and common procedure in industrial applications to form grooves in tubes and conjoint end fittings which are to be utilized in the fabrication of torque joints or torque tube assemblies employed for drive shafts and the like in order to be able to react to torsional and axial loads which are encountered in the drive shafts. Heretofore, such grooves were generally produced by machining the tubular members in a labor-intensive and time-consuming manner, thereby rendering the entire process of their manufacture expensive and not particularly economically viable.

2. Discussion of the Prior Art

Pursuant to the more recent state of the technology which is employed in the manufacture of so-called conformal torque tube joints incorporating grooves in both longitudinal and circumferential orientations in order to produce a torque joint of interlockingly conformed tubular members, the end fitting and the tube section located thereon or therein were normally joined together by concurrently forming torque-reacting grooves over an internal shaped die member or mandrel so as to eliminate the necessity for machining the grooves in the end fitting.

For example, a method of fabricating a torque joint incorporating longitudinal or axial grooves and also providing for circumferentially extending or radial grooves may be ascertained in Arena U.S. Pat. No. 4,513,488 which enable the transmission of forces or loads in both longitudinal or circumferential directions through the intermediary of thin-walled and resultingly lightweight tubular torque tubes. In that instance, an inner tube and an outer tube are overlapped, a mandrel possessing longitudinal and circumferential grooves or ridges inserted therein, and an externally applied and radially inwardly directed deformation force compresses the tubular members into the grooves or between the ridges in the mandrel, subsequent to which the mandrel or at least the inserted portion of the mandrel is extracted to then provide the formed torque tube joint.

In Arena, et al. U.S. Pat. No. 4,523,872, there is disclosed a torque tube employing end members interconnected by means of a tubular member, wherein the end members are provided with a male extension having radially spaced, axially extending grooves, with the number of grooves, outer diameter of each end member, groove width and groove length being in prescribed proportions and ratios. The ends of the tubular member are positioned over the male end member extension and the tube walls conformed to the end member and grooves through the external application of electromagnetic energy so as to cause the tube walls to be recessed or radially inwardly compressed into the grooves.

Various methods and apparatus describing the formation of grooves in tubular members in either mechanical or electromagnetic modes, particularly such as for the formation of torque joints and the like which are suitable for diverse physical and mechanical applications are disclosed in Suh, et al. U.S. Pat. No. 4,397,171; Ohki U.S. Pat. No. 4,598,451; Queyroix U.S. Pat. No. 3,810,372; Grob U.S. Pat. No. 4,125,000; Clements U.S. Pat. No. 2,233,471; Savon U.S. Pat. No. 1,329,479; and Bright, et al. U.S. Pat. No. 1,291,388.

Each and every one of the foregoing patents, although disclosing the formation of grooves in tubular members, for example, such as for the formation of torque joints for drive shafts, aircraft control linkages, and the like, disclose either mechanical devices for compressing the tubular material, and/or electromagnetic force-generating devices which are normally externally applied so as to form longitudinal and circumferential grooves, or devices generating internal electromagnetic forces in cooperation with external dies so as to provide longitudinally extending grooves in tubular members.

More recently, torque tube joints of the type described hereinabove, and which possess both longitudinal and circumferential grooves, have been formed through the application of electromagnetic forces produced by internal coils and with external die structure having either radially inwardly depending raised ridges or groove-like recesses formed in the tube-encompassing bores thereof so as to facilitate expansion of the superimposed tubular members within the bores to produce conformal longitudinal and circumferential grooves therein. Although the outwardly expansive deformation rather than radially inwardly directed compressive forces applied to the tube member material enables the formation of conformal torque tube joints which facilitates reaction to the applications of greater forces onto the torque tube joints, the formation of axially and radially oriented grooves in the torque joints is subject to physical limitations. Thus, in current designs when a drive shaft or torque tube joint is highly (operatively) loaded, the material thereof normally tends to react the applied torque in a generally spiral direction. Consequently, as can be demonstrated through structural testing, when a tubular member is loaded statically in torsion, the material reaches a point at which the tubular member may fail by torsional buckling or by the shearing of the metal, or through a tensile stress failure of the tube material. Such tubes generally exhibit a deformation which assumes a spiral appearance, and in a similar manner when a torque tube of conventional design; in effect, possessing axially and radially extending grooves, is tested for fatigue by a repetitive application of torque loads in alternating opposite directions, the tube will generally fail at the beginning or the end of the axially oriented grooves. The reason for this failure may be found in that the groove which is aligned axially and the material of the tube have a tendency to align themselves in a spiral pattern in order to react the torsional loads applied thereto, and the transition between the end of the axial groove and the tube material itself creating a stress concentration which generates a weak link in the torque tube assembly, thereby reducing its fatigue life and, consequently, its useful service life.

In order to ameliorate or even obviate the above-mentioned problem by forming the grooves in the tubular members in a spiral orientation, the grooves are essentially positioned in an optimized pattern so as to efficiently react any forces imposed on the torque tube and, resultingly, eliminate or reduce any adverse stress concentrations to impart superior properties and improvements in comparison with current state-of-the-art torque tube assemblies.

SUMMARY OF THE INVENTION

In accordance with the present invention, in clear contrast with the foregoing state-of-the-art, and in a unique and novel manner of producing conformal tubular torque joints possessing superior strength and loading properties from interengaged tubular members and end fittings; in effect, for the formation of an array or pattern of spiral grooves, an external die which encompasses the area of the components which is to be joined, has radially inwardly extending raised ridges machined or suitably formed in an inner bore surface of the die in a peripherally spaced spiral arrangement such that upon an electromagnetic force being imparted to superimposed tubular members which are positioned within the bore by means of an internal electromagnetic coil, the tubular members will be conjointly radially outwardly expanded so as to cause the surface portions or lands of the tubular members located intermediate the ridges in the die bore to contact the annular or circumferential surface of the bore and to resultingly form a pattern of inwardly projecting spiral grooves in the torque tube assembly.

In order to impart superior torque or load reacting qualities and strength to the conformal torque joint in both or opposite directions of applications of torque loads, there may be provided further external finger die assembly having a plurality of spirally curved fingers adapted to be arranged about the exterior surface of the superimposed tubular members, whereby the direction of orientation or twist of the spiral fingers is opposite to the direction of orientation or twist of the spiral ridges in the bore of the external die. In order to enable deformation of a composite pattern of spiral grooves oriented in opposite directions so as to essentially produce a so-called "diamond" or lattice-like pattern of spiral grooves in the conformed tubular torque joint members, circumferentially spaced slots or grooves may be cut into the radially inwardly raised ridges in the die bore, and which are of a number equal to the number of spiral fingers of the external finger die member which is positioned on the circumference of the tubular members. This will enable the spiral fingers to be arranged so as to extend in position within the ridges of the die bore, and assume their locations extending through the slots or grooves which are provided in the ridges, and upon the application of an electromagnetic force by means of an internal electromagnetic coil present in the tubular members within the region of the external die and the finger die, produce a radial expansion of the tubular members so as to extend outwardly into the die bore spaces intermediate the spiral fingers and the therewith interengaged spiral ridges which extend radially inwardly from the die bore.

Upon completion of the electromagnetic expansion to produce the conformal torque joint having the pattern, i.e., "diamond" shaped or lattice-like array, of spiral grooves formed therein, in order to disassemble the formed torque tube assembly from the external and spiral finger dies, it is merely necessary to impart rotation to the external finger die in a spiral motion relative to the external die so as to provide an axial displacement similar to unscrewing a screw-type fastener from a mating threaded aperture. Upon the finger die having been removed from engagement with the spiral ridges in the bore of the external die, the formed torque tube joint can then be readily removed or detached from the external die by merely imparting rotation thereto in the opposite direction, thereby completely disassembling all of the components, and with the torque tube having the so-called "diamond" shaped or lattice-like pattern of conformal spiral grooves formed therein.

The utilization of an internal coil to generate the electromagnetic forces for expanding the superimposed tubular torque tube members rather than external coil and internal forming mandrel, also causes the coil to be more stable so as not to tend to degrade with repeated use, as is generally the case with external coils.

As mentioned hereinabove, the formation of the conformal torque joints or tubular members of the type described herein incorporating the spiral grooves, particularly by means of the inventive forming method and composite die arrangement consisting of an external die and also a spiral finger die member operating in cooperation to form the "diamond" shaped or lattice-like pattern of oppositely oriented intersecting spiral grooves in the torque joint, enables the utilization of the torque joints for a wide range of diverse physical applications, both military and commercial; for example, in mechanical systems in which it is desired to transmit driving forces or loads, for instance, such as an automotive drive train links or steering arrangements, aircraft controls, as well as for the drive shafts of automobiles and various marine propulsion devices. The torque joints may also be employed for the transmission of loads in structures located in mechanisms for positioning and controlling air flow surfaces of aircraft or the like, and in numerous applications, particularly where it is intended to provide torsional loading of the torque joints ill opposite rotational directions in a highly repetitive manner.

Accordingly, it is a primary aspect of the present invention to provide a method for the formation of a conformal torque joint incorporating a pattern or array of spiral grooves which are in a predetermined spaced relationship to each other. Moreover, the method also contemplates the formation of spiral grooves in a conformal torque joint whereby the grooves may be oriented in opposite directions so as to form essentially "diamond" shaped or lattice-like groove patterns or arrays.

In order to be able to implement the foregoing method for the formation of a conformal torque joint incorporating the novel spiral grooves, the invention further contemplates the provision of an external annular die encompassing the superimposed tubular members which are adapted to form the tubular torque joint, and with an inner bore extending about the tubular members at a predetermined annular spatial relationship, with the die bore including radially inwardly depending raised ridges in the shape of a spiral pattern. Thus, upon the energizing of an internal coil arranged within the tubular members so as to generate an electromagnetic force in the region within the external die bore, the material of the tubular members will be expanded so as to conformingly engage the surface portions of the cylindrical bore in the external die intermediate the ridges, thereby producing an outwardly displaced surface of the superimposed tubular members possessing radially inwardly directed spiral grooves which are reactive to both axial and torsional forces which may be applied to the resultingly formed torque joint.

In order to enable the torque joint to be utilized for reacting to reverse torque loads which are imparted thereto, it is desirable that a second pattern of spiral grooves be formed in the region possessing the first mentioned pattern spiral grooves but which are oriented in an opposite direction relative thereto so as to form an essentially "diamond" shaped or lattice-like spiral groove pattern, thereby adapting the torque joint to react to axial forces and to torsional forces which are applied in opposite rotational directions, while concurrently avoiding the generating of stress concentrations in the torque joint.

In order to produce the so-called "diamond" pattern of oppositely oriented spiral grooves, cut-outs, slots or grooves may be formed in circumferentially spaced relationship in the radially inwardly extending raised ridges of the die bore, so that a further die member encompassing the outer circumference of the superimposed tubular members, and which is provided with spiral finger members which are spirally oriented opposite the spiral orientation of the ridges in the die bore, is able to have the latter threaded through the cut-outs or slots in the raised ridges about the circumference of the tubular members which are adapted to form the torque joint. Thus, the pattern or array of raised ridges in the external die bore and the therewith interengaged spiral fingers of the external finger die member encompassing the tubular members conjointly form a pattern which, upon an electromagnetic force being applied to the tubular members by means of an internal coil, causes the spaces therebetween to be filled by the expanded tubular member material, and to impress or form a pattern or array of oppositely oriented radially inwardly extending spiral grooves in the superimposed tubular members so as to produce the torque joint.

The spiral grooves thus provide a pattern in the torque joint which is reactive to both axial and torsional forces which may be applied to the tube members of the resultingly formed torque joint, and which substantially, or potentially even completely, eliminates excessive stresses and stress concentrations in the groove portions of the torque joints.

Accordingly, it is an object of the present invention to provide a method of forming spiral grooves in a conformal tubular torque joint through the application of an internal electromagnetic force expanding two superimposed tubular members about spiral ridges formed in an internal bore surface of an external die structure.

Another object of the present invention is to provide a novel method of forming conformal torque joints and groove tubular members including a pattern of oppositely directed spiral grooves which form a so-called "diamond" shaped or lattice-like groove pattern through the utilization of an external finger die member having a plurality of circumferentially spaced spiral fingers oriented oppositely the spiral orientation of the ridges in the external die bore, such spiral fingers being insertable into cut-outs or slots cut into the spiral ridges of the external die bore to form conjointly the specified pattern in the tubular members.

Still another object of the present invention is to provide a novel external die construction having an internal cylindrical bore surface encompassing tubular members and incorporating spirally oriented raised ridges enabling expansion of the tubular members through the application of an internal electromagnetic force so as to form a conformal torque joint having circumferentially spaced spiral grooves therein.

Yet another object of the present invention is to provide an external die for the formation of torque joints incorporating spiral grooves through the application of an internal electromagnetic force of the type described herein, and including a further external finger die assembly having spiral fingers extending about the tubular members for producing the torque joints and whereby the spiral fingers are oriented in a direction opposite to the spirals of the external die and which are interengaged therewith so as to enable the formation of a "diamond" shaped spiral groove pattern in the torque joint.

BRIEF DESCRIPTION OF THE DRAWINGS

Reference may now be had to the following detailed description of a preferred exemplary embodiment of the invention, taken in conjunction with the accompanying drawings; in which.

DETAILED DESCRIPTION OF A PREFERRED EMBODIMENT

Figure 1:
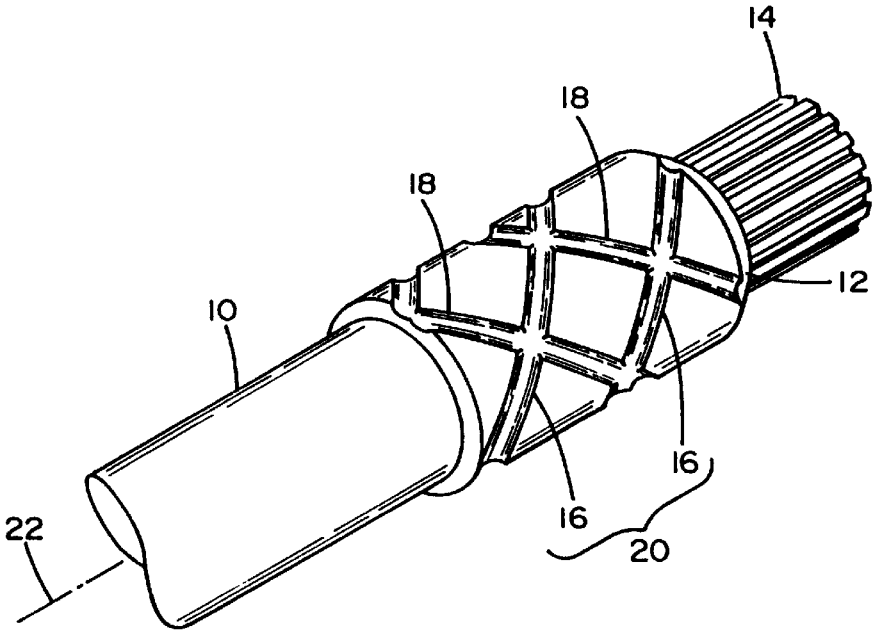
FIG. 1 illustrates a generally schematic longitudinal perspective view of a superimposed tubular member and end fitting having a spiral groove pattern formed therein through the intermediary of the inventive die arrangement.

Referring in particular to FIG. 1 of the drawings, there is illustrated, in a perspective view, a pair of tubular members 10, 12, each preferably consisting of aluminum or other lightweight metal in order to be able to form a lightweight torque joint of which the first of the tubular members 10 has the second tubular member 12 inserted therein in closely fitting slidable engagement, or alternatively, is adapted to extend thereover. The second tubular member 12 is illustrated as having a splined end 14 for providing a fitted or load-transmissive connection with a suitable drive arrangement or the like structure (not shown). However, in lieu of the splined end 14, the second tubular member 12 may comprise an end fitting which possesses a clevis-type or bifurcated structure (not shown) for forming a linkage or articulated connection, such as for an automobile steering control system or for an aircraft actuating linkage system for controlling airfoil flow surfaces and the like, although other numerous physical applications; for instance, such as marine propulsion systems, and various military or commercial utilizations, also readily lend themselves to the present invention in widely diverse industrial applications requiring the use of torque joints.

As illustrated in FIG. 1, in order to form the torque joint, there is provided a set of circumferentially spaced grooves 16, 18 radially inwardly extending in the tubular members 10, 12 in an oppositely oriented spiral pattern so as to form an essentially "diamond" shaped or lattice-like groove pattern in the overlapping region 20 of the tubular members by means of the inventive die arrangement, as described in further detail hereinbelow.

The groove pattern which is constituted from the oppositely oriented conformally formed spiral grooves 16, 18 which are circumferentially spaced within region 20 about the periphery of the superimposed tubular members 10, 12, may be of any specified mutual angular relationship with respect to each other, which can vary over a wide range and is not limited to any particular angle subtended relative to the longitudinal center axis 22 of the torque joint. The angle of the spiral grooves relative to each other and to the longitudinal center axis 22 of the torque joint may be determined by the metallurgical characteristics or properties of the materials being employed for the tubular members 10, 12, and the axial and/or torque forces which are expected to be applied to the torque joint. Moreover, the selected length of the conformal grooves, in effect, the axial length of the torque joint which is located within the region 20 of deformation is also essentially dependent upon the metalurgical characteristics or properties of the materials employed, and the forces which are expected to be applied to the torque tube assembly or joint.

Figure 2:
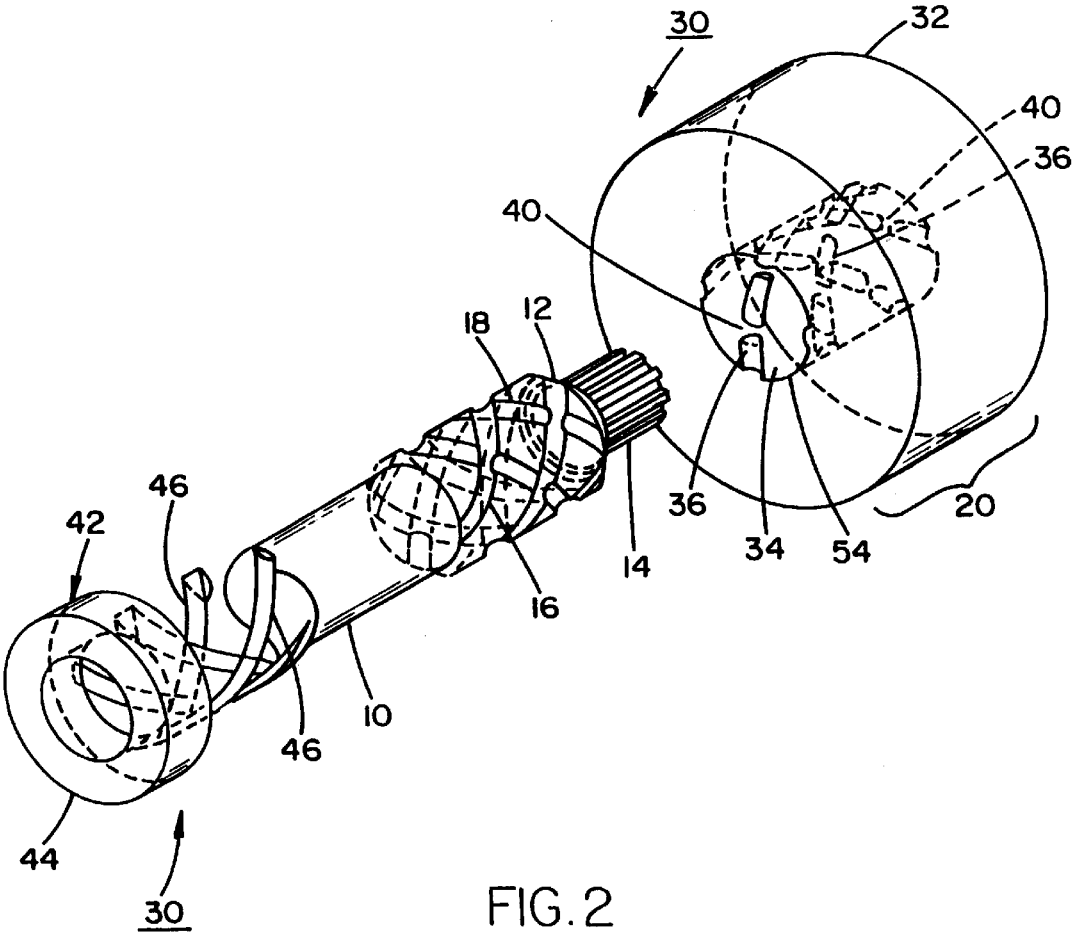
FIG. 2 illustrates, generally diagrammatically, an exploded perspective view of the torque joint having a "diamond" shaped pattern of oppositely oriented spiral grooves formed therein, and with the external die member and the therewith cooperative external finger die member shown in the position of having been removed from the external die member.
Figure 3:
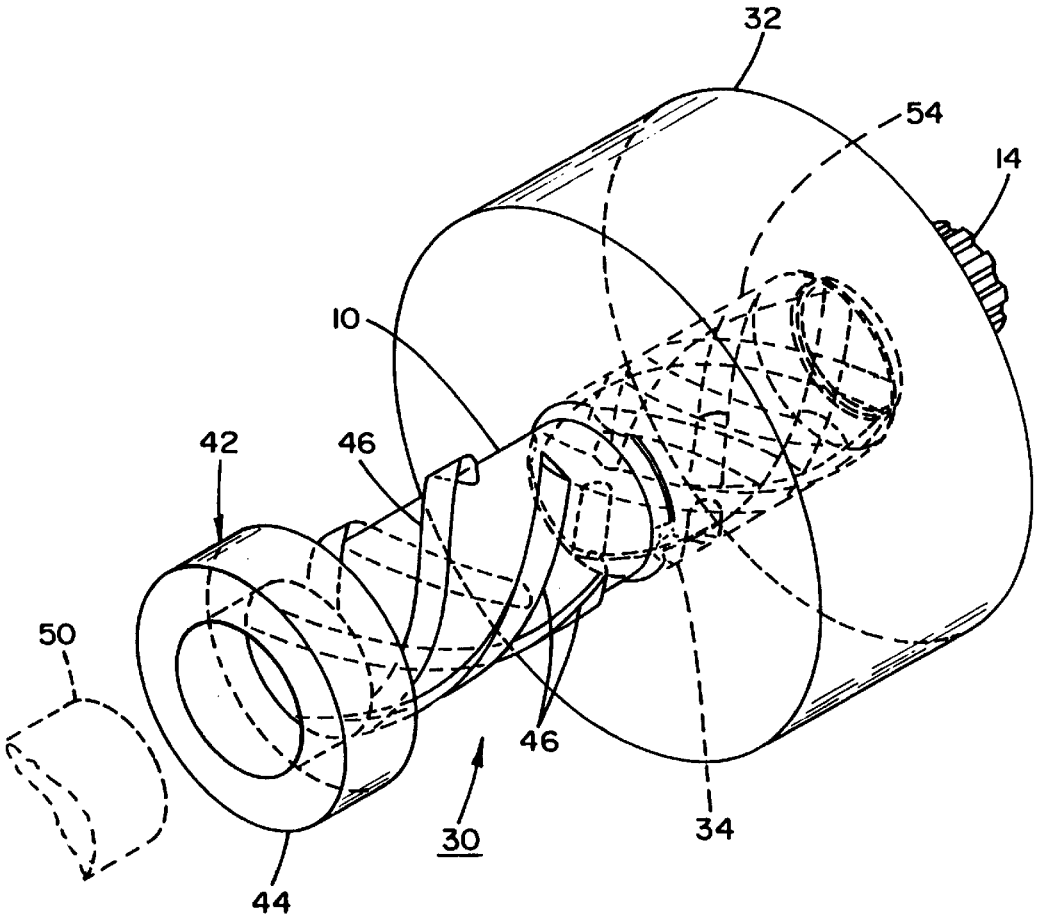
FIG. 3 illustrates, generally diagrammatically, the die arrangement showing the external die in position about the torque joint forming region, and with the removable finger die member being shown adapted to be inserted therein.

Reverting in particularity to FIGS. 2 and 3 of the drawings, the die arrangement 30 for forming the conformal torque joint of FIG. 1 comprises a first external or annular die 32 having an inner bore 34, with the external die 32 being formed of either a suitable metallic material, a dense plastic or a composite, as may be desired. The inner bore 34 of the external die includes a plurality of circumferentially spaced raised or radially inwardly projecting spiral ridges 36 extending over substantially the width of the die 32 which is in conformance with the region 20 of the torque tube assembly shown in FIG. 1 of the drawings, and wherein the radial inwardly extending height of each of the spiral ridges 36 determines the depth of the conformal spiral grooves which are to be formed in the tubular members 10, 12. The external diameter of the tubular members 10, 12 within region 20, in essence, the outermost diameter thereof prior to the forming thereof of the grooves, is essentially identical to the internal diameter within the die bore as defined by the radially inwardly located peaks of the spiral ridges 36.

Formed in each of the ridges 36 at predetermined axial and circumferential spacings thereof are undercuts or slots 40 to enable a movable finger die assembly 42 consisting of a ring 44 having axially projecting circumferentially spaced fingers 46, each of which extends in a spiral configuration oriented in an opposite direction to that of the spiral ridges 36 in the die bore 34, are positioned on the tubular members 10, 12 and adapted to be twisted or screwed into the die 34 bore so as to cause the respective fingers 46 to engage in, respectively, each of the slots 40 cut into the ridges 36, thereby forming an essentially "diamond" shaped die ridge pattern. The inner diameter of the ring 44, in effect, the internal diameter defined by the collective spiral fingers 46 closely encompasses the outer circumference of the external tubular member 12 (or 10) which is to be inserted and then twisted or screwed into the bore 34 of the external die 32, whereby in the fully assembled position of the die arrangement 30, the fingers 46 of the finger die assembly 42 are interengaged with the ridges 36 in the bore 34 and define the same internal diameter therewith about the tubular members 10, 12.

An energizable coil member 50 which is adapted to generate an electromagnetic force is insertable into the tubular members 10, 12 when the latter are inserted into the die arrangement 30 so as to be located in place within the region 20 of the external die 32 and the spiral fingers 46. Upon the application of an internal electromagnetic force by means of the coil member, this then causes the superimposed segments of the tubular members 10, 12 within the region 20 to be expanded or deformed radially outwardly, such that the surface portion of the tubular members 10, 12 intermediate the spiral ridges 36 in the die bore 34 and the fingers 46 of the finger die assembly 42 come into surface contact with the bottom or radially outermost surface 54 of the die bore 34. This conformal deformation of the tubular members 10, 12 within region 20 forms the radially inwardly extending pattern of spiral grooves 16, 18 in the torque tube assembly or torque joint as shown in FIG. 1, the latter of which, in the region 20, has then an outer diameter in conformance with the outer diameter 54 of the bore 34 of external die 32.

The deforming process essentially locks the tubular members 10, 12 together to form the conformal torque joint. Inasmuch as it is impossible to remove the die components and the formed torque joint apart from each other by merely pulling these in an axial direction due to the presence of the now interlocked torque tube grooves, die ridges and fingers, in order to separate these elements, the finger die assembly 42 may be simply rotated in correlation with the orientation of its spiral fingers 46, in the manner of a screwthread being threaded out of a mating aperture, so as to be displaced axially out of the external die 32. Thereafter, the torque joint consisting of the conformed tubular members 10, 12 be rotated in the opposite direction so as to be effectively unscrewed from the ridges 36 in the bore 34 of the external die 32, thereby releasing the completed torque joint as shown in FIGS. 1 and 3 of the drawings.

Thereafter, the entire procedure as described hereinabove may be repeated for the forming of another conformal torque joint assembly.

The utilization of the external finger die assembly 42 which is adapted to be twisted or threaded into the external die bore 34 offers an arrangement for the forming of patterns of spiral grooves in the tubular members, while concurrently enabling disassembly of the components subsequent to the forming of the torque joint.

From the foregoing, it becomes readily apparent that the invention provides for a unique and novel method and die structure for the manufacture of torque tube assemblies or torque joints incorporating predetermined spiral groove patterns therein which will impart the inventively advantageous load reactive properties thereto.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A method of fabricating a torque joint between two tubular members having one end of one tubular member inserted into an end of the other tubular member to provide an overlapping region between the tubular members; comprising the steps of:

(a) positioning a first die member having a plurality of spirally extending, axially parallel fingers on said tubular members such that said fingers are located to extend along the outer surface of the overlapping region of said tubular members;

(b) encompassing the overlapping region of said tubular members and the fingers of said first die member with a second annular external die having an inner cylindrical bore surface facing the outer surface of said overlapping region, said inner bore surface having a plurality of circumferentially spaced axially extending spiral ridges oriented opposite the spiral orientation of the fingers of said first die member, said spiral ridges projecting radially inwardly so as to contact the outer circumferential surface of said tubular members, said spiral fingers being interengaged with said spiral ridges so as to form a predetermined lattice-like pattern with said spiral ridges, and said inner bore surface defining an annular space with the outer circumferential surface of said tubular members commensurate with the height of said ridges and the thickness of each of said fingers;

(c) inserting an electromagnetic coil into said tubular members so as to extend into said overlapping region within the confines of said first and second annular dies; and (d) connecting said electromagnetic coil to a source of electrical energy and imparting an electromagnetic force to the interior of said tubular members in said overlapping region by said electromagnetic coil so as to generate an electromagnetic deformation force expanding said tubular members radially outwardly within said overlapping region so as to impress said pattern of interengaged spiral ridges and fingers onto said tubular members to produce a corresponding pattern of spirally oriented grooves therein forming said torque joint.

2. A method as claimed in claim 1, wherein said tubular members have the circumferential surface portions intermediate said spiral ridges expanded within said overlapping region so as to assume an outer diameter in close contact with the diameter of the inner cylindrical bore surface of said second annular external die.

3. A method as claimed in claim 1, wherein said first die member comprises a ring element, said spiral fingers extending in parallel axial relationship from an end surface of said ring element.

4. A method as claims in claim 1, wherein said tubular members are expanded to form said pattern of spiral grooves therein, and axially withdrawing said first die member from said second annular external die through rotation of said first die member causing said spiral fingers to disengage from said ridges in the bore of said second annular external die.

5. A method as claimed in claim 4, including withdrawing said tubular members from said second annular external die subsequent to withdrawal of said first die member by rotation in an opposite direction so as to disengage the grooves formed in said tubular members from said ridges in the bore of said second annular external die.

6. A method as claimed in claim 1, wherein at least one of said tubular members comprises an end fitting for a torque joint.

7. A method as claimed in claim 1, wherein said coil means comprises an electromagnetic coil member insertable into said tubular members and having external circumferential dimensions so as to be in close contact with the internal diameter of said tubular member within said overlapping region.

8. A die arrangement for fabricating a torque joint between two tubular members having one end of one tubular member inserted into an end of the other tubular member to provide an overlapping region between the tubular members; comprising:

(a) a first die member having a plurality of spirally extending, axially parallel fingers being positioned on said tubular members such that said fingers are located to extend along the outer surface of the overlapping region of said tubular members;

(b) a second annular external die encompassing the overlapping region of said tubular members and the fingers of said first die member, said second annular external die having an inner cylindrical bore surface facing the outer surface of said overlapping region, said inner bore surface having a plurality of circumferentially spaced axially extending spiral ridges oriented opposite the spiral orientation of the fingers of said first die member, said spiral ridges projecting radially inwardly so as to contact the outer circumferential surface of said tubular members, said spiral fingers being interengaged with said spiral ridges so as to form a predetermined lattice-like pattern with said spiral ridges, and said inner bore surface defining an annular space with the outer circumferential surface of said tubular members commensurate with the height of said ridges and the thickness of each of said fingers; and (c) an electromagnetic coil being inserted into said tubular members so as to extend into said overlapping region within the confines of said first and second annular dies, a source of electrical energy being connected to said coil for imparting an electromagnetic force to the interior of said tubular members in said overlapping region so as to generate an electromagnetic deformation force expanding said tubular members radially outwardly within said overlapping region so as to impress said pattern of interengaged spiral ridges and fingers onto said tubular members to produce a corresponding pattern of spirally oriented grooves therein forming said torque joint.

9. A die arrangement as claimed in claim 8, wherein said tubular members have the circumferential surface portions intermediate said spiral ridges expanded within said overlapping region so as to assume an outer diameter in surface contact with the diameter of the inner cylindrical bore surface of said second annular external die.

10. A die arrangement as claimed in claim 8, wherein said first die member comprises a ring element, said spiral fingers extending in parallel axial relationship from an end surface of said ring element.

11. A die arrangement as claimed in claim 8, wherein said spiral ridges are provided with circumferentially spaced cut-outs to facilitate passage therethrough of said spiral fingers for interengagement with said spiral ridges.

12. A die arrangement as claimed in claim 8, wherein upon said tubular members having been expanded to form said pattern of spiral grooves therein, said first die member is axially withdrawn from said second annular external die through rotation of said first die member causing said spiral fingers to disengage from said ridges in the bore of said second annular external die.

13. A die arrangement as claimed in claim 12, wherein said tubular members are withdrawable from said second annular external die subsequent to withdrawal of said first die member by rotation in an opposite direction so as to disengage the grooves formed in said tubular members from said ridges in the bore of said second annular external die.

14. A die arrangement as claimed in claim 8, wherein at least one of said tubular members comprises an end fitting for a torque joint.

15. A die arrangement as claimed in claim 8, wherein said electromagnetic coil comprises cylindrical coil member insertable into said tubular members and having an external diameter in close contact with the internal diameter of said tubular member within said overlapping region.

16. A die arrangement as claimed in claim 8, wherein said first and second die members are constituted of a material selected from the group of materials consisting of metals, dense plastics and composites of said materials.

* * * * *